US007476276B2

(12) United States Patent
Behrens et al.

(10) Patent No.: US 7,476,276 B2
(45) Date of Patent: Jan. 13, 2009

(54) DEVICE FOR HOT DIP COATING A METAL STRIP

(75) Inventors: Holger Behrens, Erkrath (DE); Rolf Brisberger, Spielberg (AT); Hans-Georg Hartung, Pulheim (DE); Bernhard Tenckhoff, Duisburg (DE); Walter Trakowski, Duisburg (DE); Michael Zielenbach, Siegen (DE)

(73) Assignee: SMS Demag AG, Düsseldorf (DE)

( * ) Notice: Subject to any disclaimer, the term of this patent is extended or adjusted under 35 U.S.C. 154(b) by 29 days.

(21) Appl. No.: 10/563,583

(22) PCT Filed: Jun. 16, 2004

(86) PCT No.: PCT/EP2004/006479

§ 371 (c)(1),
(2), (4) Date: Jun. 13, 2006

(87) PCT Pub. No.: WO2005/005681

PCT Pub. Date: Jan. 20, 2005

(65) Prior Publication Data

US 2006/0243203 A1 Nov. 2, 2006

(30) Foreign Application Priority Data

Jul. 8, 2003 (DE) ..... 103 30 656

(51) Int. Cl.
*B05C 3/02* (2006.01)

(52) U.S. Cl. ..... 118/405; 118/419

(58) Field of Classification Search ..... 118/419, 118/429, 405; 427/436, 435, 434.2; 164/419
See application file for complete search history.

(56) References Cited

U.S. PATENT DOCUMENTS 928,385 A * 7/1909 Huxley ..... 432/197
5,587,017 A * 12/1996 Yamanaka et al. ..... 118/424

FOREIGN PATENT DOCUMENTS

EP 0 659 897 6/1995

OTHER PUBLICATIONS

Patent Abstracts of Japan, BD. 1999, No. 12, Oct. 29, 1999 & JP 11 193451 A (Mitsubishi Heavy Ind Ltd) Jul. 21, 1999.

(Continued)

*Primary Examiner*—Brenda A Lamb
(74) *Attorney, Agent, or Firm*—Friedrich Kueffner

(57) ABSTRACT

The invention relates to a device for hot dip coating a metal bar (1), especially a steel strip, in which the metal bar (1) is directed vertically through a container (3) accommodating the molten coating metal (2) and through a guide channel (4) mounted upstream thereof. The inventive device comprises at least two inductors (5) which are arranged on both sides of the metal bar (1) in the area of the guide channel (4) and generate an electromagnetic field for retaining the coating metal (2) inside the container (3). In order to relax the coating bath, the distance (d) between the walls (6) that delimit the guide channel (4) is not kept constant in a direction (N) extending perpendicular to the surface of the metal strip (1) in the zone (H) of the vertical extension of the guide channel (4), which is located between the bottom side (7) thereof and the bottom area (8) of the container (3).

13 Claims, 3 Drawing Sheets

OTHER PUBLICATIONS

Patent Abstracts of Japan, BD. 1995, No. 06, Jul. 31, 1995 & JP 7 076 759 A (Kawasaki Steel Corp), Mar. 20, 1995.
Patent Abstracts of Japan, BD. 1995, No. 02, Mar. 31, 1995 & JP 6 306 556 A (NKK Corp) Nov. 1, 1994.
Patent Abstracts of Japan, BD. 0174 No. 92, Sep. 7, 1993 & JP 5 125 512 A (NKK Corp) May 21, 1993.
Patent Abstracts of Japan, BD. 0041, No. 59, Nov. 6, 1980 & JP 55 104 466 A (Nippon Paint Co Ltd), Aug. 9, 1980.

* cited by examiner

DEVICE FOR HOT DIP COATING A METAL STRIP

The invention concerns a device for hot dip coating a metal strand, especially a steel strip, in which the metal strand is passed vertically through a coating tank that contains the molten coating metal and through a guide channel upstream of the coating tank, with at least two inductors for inducing an electromagnetic field, which are installed on both sides of the metal strand in the area of the guide channel in order to keep the coating metal in the coating tank.

Conventional metal hot dip coating installations for metal strip have a high-maintenance part, namely, the coating tank and the fittings it contains. Before being coated, the surfaces of the metal strip must be cleaned of oxide residues and activated for bonding with the coating metal. For this reason, the strip surfaces are subjected to heat treatments in a reducing atmosphere before the coating operation is carried out. Since the oxide coatings are first removed by chemical or abrasive methods, the reducing heat treatment process activates the surfaces, so that after the heat treatment, they are present in a pure metallic state.

However, this activation of the strip surfaces increases their affinity for the surrounding atmospheric oxygen. To prevent the surface of the strip from being reexposed to atmospheric oxygen before the coating process, the strip is introduced into the hot dip coating bath from above in an immersion snout. Since the coating metal is present in the molten state, and since one would like to utilize gravity together with blowing devices ("air squeegee") to adjust the coating thickness, but the subsequent processes prohibit strip contact until the coating metal has completely solidified, the strip must be deflected in the vertical direction in the coating tank. This is accomplished with a roller that runs in the molten metal. This roller is subject to intense wear by the molten coating metal and is the cause of shutdowns and thus loss of production.

The desired low coating thicknesses of the coating metal, which can vary in the micrometer range, place high demands on the quality of the strip surface. This means that the surfaces of the strip-guiding rollers must also be of high quality. Problems with these surfaces generally lead to defects in the surface of the strip. This is a further cause of frequent plant shutdowns.

To avoid the problems associated with rollers running in the molten coating metal, approaches have been proposed, in which a coating tank is used that is open at the bottom and has a guide channel of well-defined height in its lower section for guiding the strip vertically upward, and in which an electromagnetic seal is used to seal the open bottom of the coating tank. The production of the electromagnetic seal involves the use of electromagnetic inductors, which operate with electromagnetic alternating or traveling fields that seal the coating tank at the bottom by means of a repelling, pumping, or constricting effect.

A solution of this type is described, for example, in EP 0 673 444 B1 and EP 0 659 897 A1. The solutions proposed in WO 96/03533 and JP 50[1975]-86,446 also involve the use of an electromagnetic seal for sealing the coating tank at the bottom.

The solution described in JP 11[1999]-193,451 A also involves the use of an electromagnetic seal at the bottom of the coating tank for holding the coating metal in the coating tank. The cited document describes a funnel-like contour that narrows towards the top at the bottom of the coating tank.

DE 195 35 854 A1 and DE 100 14 867 A1 offer special approaches to the solution of the problem of precise position control of the metal strand in the guide channel. According to the concepts disclosed there, the coils for inducing the electromagnetic traveling field are supplemented by correction coils, which are connected to an automatic control system and see to it that when the metal strip deviates from its center position, it is brought back into this position.

The electromagnetic seal used in the solutions discussed above for the purpose of sealing the guide channel constitutes in this respect a magnetic pump that keeps the coating metal in the coating tank.

Industrial trials of installations of this type have shown that the flow pattern on the surface of the metal bath, i.e., the bath surface, is relatively turbulent, which can be attributed to the electromagnetic forces produced by the magnetic seal. The turbulence in the bath has a negative effect on the quality of the hot dip coating. As has already been mentioned, the "air squeegee" located above the coating tank blows excess molten metal from the coated strand. A relaxed metal bath surface is essential for achieving precise adjustment of the coating thickness.

For the purpose of relaxing the bath, it is not possible to reduce the intensity of the magnetic field to any appreciable extent without endangering the tightness of the magnetic seal. Specifically, it is known from DE 102 54 307 A1 that to ensure the tightness of the seal as a function of the height of the molten metal level in the coating bath, a certain minimum intensity of the magnetic field is necessary. The cited document provides that the level of the magnetic field strength produced by the inductors is determined as a function of the level of the molten coating metal in the coating tank.

Therefore, the objective of the invention is to develop a device of the aforementioned type for the hot dip coating of a metal strand, with which it is possible to overcome the specified disadvantage. In other words, the goal is to ensure that the hot dip coating bath will remain undisturbed during the use of an electromagnetic seal and thus that the quality of the coating will be improved.

The achievement of this objective by the invention is characterized by the fact that the distance between the walls that bound the guide channel is not constant in the direction normal to the surface of the metal strand in the region of the vertical extent of the guide channel between the lower end of the guide channel and the bottom of the coating tank, such that the walls that bound the guide channel have a constriction or an expansion.

The invention thus provides that the effective width of the guide channel varies over its vertical extent, such that the relevant vertical extent of the channel is the vertical height between the lower end of the channel and the bottom of the coating tank. The cross-sectional variation of the guide channel that is provided for in accordance with the invention is intended to create a zone within the vertical extent of the channel, in which relaxation of the flow in the coating metal can occur, which is intended also to relax the surface of the bath.

The cross section of the constriction or the expansion can have essentially the form of a circular segment.

In accordance with a first embodiment, the walls that bound the guide channel follow a funnel-like course, at least in a particular section of the channel. The funnel-like section can start immediately at the bottom of the coating tank with its wide end up. In this regard, it can be provided especially that the vertical extent of the funnel-like section is at most 30% of the vertical extent of the guide channel.

In an alternative or additional refinement, the walls bounding the guide channel have a constriction. Alternatively or additionally to this, it can be provided that the walls bounding the guide channel have an expansion. The cross section of the constriction or the expansion can have essentially the form of a circular segment.

In a refinement of the invention, further flow relaxation can be achieved by arranging at least one flow deflection element in the coating tank and/or in the guide channel. It is advantageous for the flow deflection element to be designed as a flat, narrow plate, whose longitudinal axis extends in the direction perpendicular to the direction of conveyance of the metal strand and perpendicular to the direction normal to the surface of the metal strand. In addition, the one or more flow deflection elements can be arranged in the guide channel in the region of the expansion.

In a further refinement, the bath surface can be further relaxed by arranging at least one bath relaxation plate in the coating tank near the surface of the coating metal. It rests on the surface of the bath or is arranged a small distance above the surface of the bath. In this connection, the position of the bath relaxation plate can be vertically adjusted by an actuator. The bath relaxation plate preferably consists of a ceramic material.

The proposed measures cause the surface of the metal bath to remain relatively still despite the use of the electromagnetic seal, which ensures high quality of the hot dip coating.

Specific embodiments of the invention are illustrated in the drawings.

Figure 1:
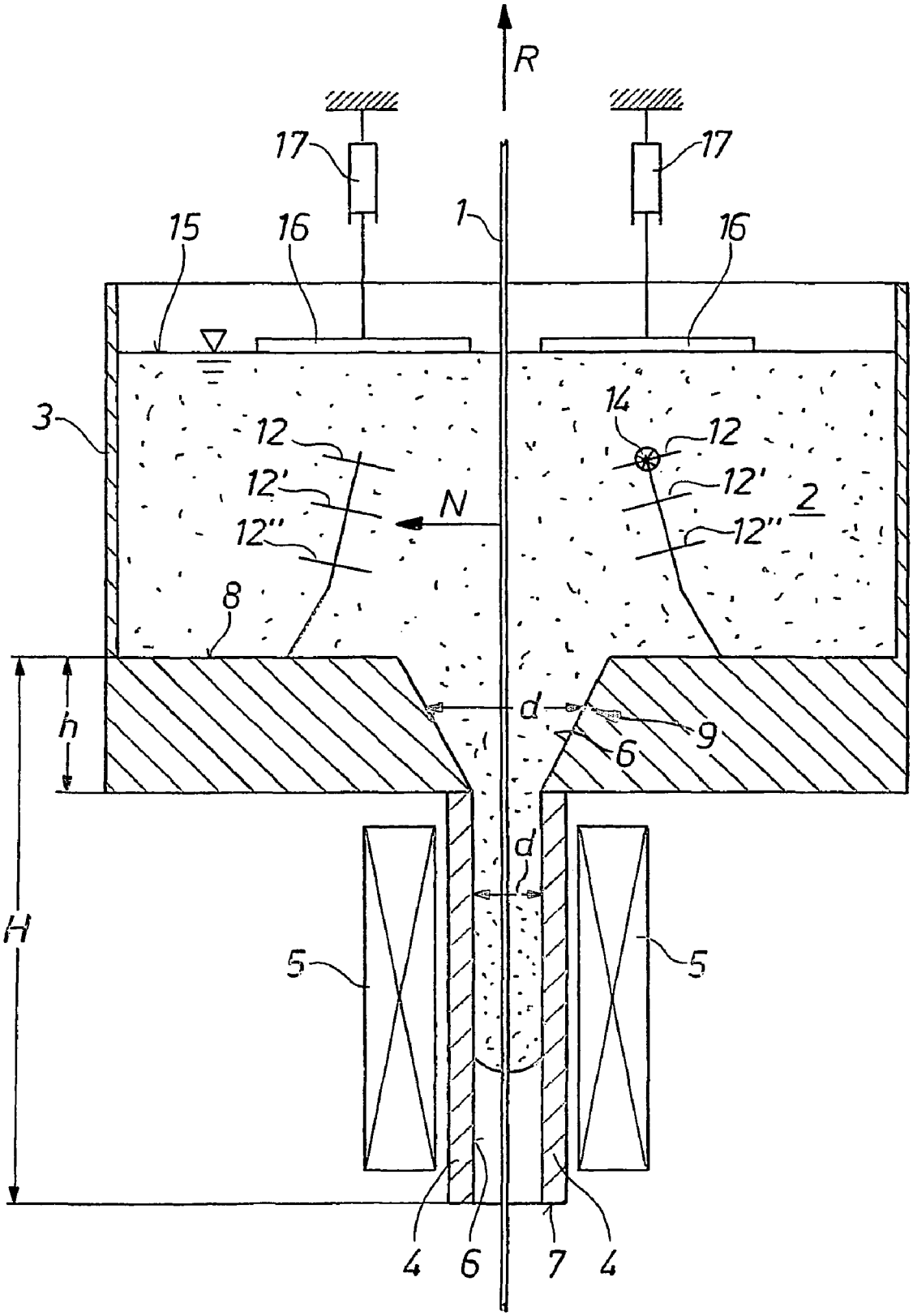
FIG. 1 shows a schematic cross-sectional side view of a hot dip coating device with a metal strand being conveyed through it.

The device illustrated in the drawings has a coating tank 3, which is filled with molten coating metal 2. The molten coating metal 2 can be, for example, zinc or aluminum. The metal strand 1, e.g., in the form of a steel strip, is coated by passing it vertically upward through the coating tank 3 in direction of conveyance R. It should be noted at this point that it is also basically possible for the metal strand 1 to pass through the coating tank 3 from top to bottom.

To allow passage of the metal strand 1 through the coating tank 3, the latter is open at the bottom, where a guide channel 4 is located. The guide channel 4 is shown exaggeratedly large or wide here. It has a region H of vertical extent. In this regard, it should be noted that this region H is calculated from the bottom 8 of the coating tank 3 to the lower end 7 of the guide channel 4 and is the region that provides an opening gap for the passage of the metal strand 1.

To prevent the molten coating metal 2 from flowing out at the bottom through the guide channel 4, two electromagnetic inductors 5 are located on either side of the metal strand 1. The electromagnetic inductors 5 induce a magnetic field, which counteracts the weight of the coating metal 2 and thus seals the guide channel 4 at the bottom.

The inductors 5 are two alternating-field or traveling-field inductors installed opposite each other. They are operated in a frequency range of 2 Hz to 10 kHz and create an electromagnetic transverse field perpendicular to the direction of conveyance R. The preferred frequency range for single-phase systems (alternating-field inductors) is 2 kHz to 10 kHz, and the preferred frequency range for polyphase systems (e.g., traveling-field inductors) is 2 Hz to 2 kHz.

To stabilize the metal strand 1 in the center plane of the guide channel 4, correction coils (not shown) can be installed on both sides of the guide channel 4 or metal strand 1. These correction coils are controlled by automatic control devices in such a way that the superposition of the magnetic fields of the inductors 5 and of the correction coils always keep the metal strand 1 centered in the guide channel 4.

Depending on their degree of activation, the correction coils can strengthen or weaken the magnetic field of the inductors 5 (superposition principle of magnetic fields). In this way, the position of the metal strand 1 in the guide channel 4 can be influenced.

To quiet the surface of the bath in the coating tank 3, it is provided that the distance d between the walls 6 that bound the guide channel 4 is not constant in the direction N perpendicular to the surface of the metal strand 1 in the region H of the vertical extent of the guide channel 4 between the lower end 7 of the guide channel 4 and the bottom 8 of the coating tank 3.

As FIG. 1 shows, this is accomplished in the present embodiment by providing a funnel-like section 9 immediately below the bottom 8 of the coating tank 3, such that the wide end of the funnel 9 is located at the bottom 8 of the coating tank 3. Over a vertical extent h of the funnel-like section 9, the distance d between the walls 6 that bound the guide channel 4 decreases to the value that is reached below the funnel-like section 9 and then remains constant in the lower section of the guide channel 4.

The choice of this embodiment was the result of the following insight: During industrial testing of the hot dip coating devices in question, conditions arose that resulted in a quiet bath surface. However, evaluation of the data revealed that this was the result of the interplay between the level in the coating bath and the adjusted sealing capacity of the inductors 5. Furthermore, automatic control of the position of the metal strand 1 in the guide channel 4 by means of the aforementioned correction coils revealed that the automatic control interventions locally intensify the agitation of the surface of the bath. Accordingly, a combination of several competing effects is involved here. It is not feasible merely to reduce the capacity of the inductors 5, since this would result in leaks. However, as explained above, the inductor power depends on the level in the coating bath, which should be as high as possible. However, it is also necessary to provide automatic control of the position of the metal strand 1 in the guide channel 4, which produces local agitation. Therefore, the invention proposes the above-described change in the geometry of the guide channel 4 and the additional measures for relaxing the surface of the bath that will be described in detail below.

The embodiment of the guide channel 4 with the funnel-like section 9 that is illustrated in FIG. 1 is a measure that is aimed at guiding the flow in the coating metal 2 coming from the guide channel 4 in such a way that agitation of the bath does not occur at the surface of the bath. In addition, there is the possibility of using a suitable measure to locally limit the turbulence in the flow that is produced in the coating metal by the inductors 5 to the region of the guide channel 4.

The provision of the funnel-like section 9 is a first important measure, by which the flow in the coating metal 2 can be guided in the region of the guide channel 4. Bath agitation at the surface of the metal bath is reduced by the funnel-like section 9, because the proposed geometry provides room for the upwardly directed flow in the guide channel 4 to escape into the volume of the coating tank 3. The local turbulence is reduced or absorbed by this measure.

Bath agitation on the surface of the coating metal 2 is prevented or reduced by this measure. The bath agitation would otherwise prevent the "air squeegee" from being adjusted to a distance from the bath surface that is suitable for obtaining the desired quality of the coating.

Another measure for guiding the flow is the placement of bath relaxation plates 16, which are made, for example, of a ceramic material, on the surface 15 of the coating bath. The bath relaxation plates 16 are held on the surface 15 of the coating metal 2 or are positioned near the surface. This is accomplished with actuators 17, with which the horizontally oriented bath relaxation plates 16 can be adjusted to a suitable height. As a result, turbulence that may have penetrated to the surface of the bath is deflected horizontally, so that bath agitation can be prevented.

Another possible means of guiding the flow consists in the insertion of flow deflection elements 12, 12', 12", 13, 13' (designed as guide plates or guide vanes) in the molten coating metal 2. As FIG. 1 shows, these flow deflection elements 12, 12', 12" are designed as narrow plates, whose longitudinal axis 14 is perpendicular to the plane of the drawing. They are arranged at a desired angle and cause the flow in the coating metal to be deflected in the horizontal direction, so that bath agitation is minimized. In this regard, the flow deflection elements 12, 12', 12" are positioned relatively close to the metal strand 1.

Figure 3:
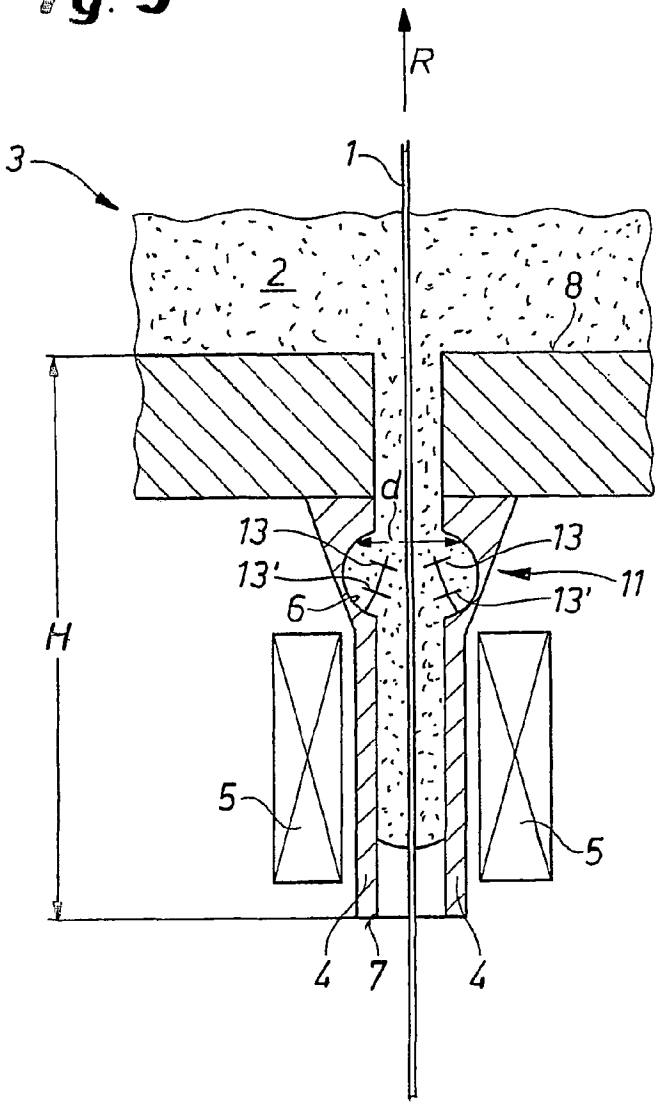
FIG. 3 shows another alternative embodiment analogous to FIG. 2.
Figure 2:
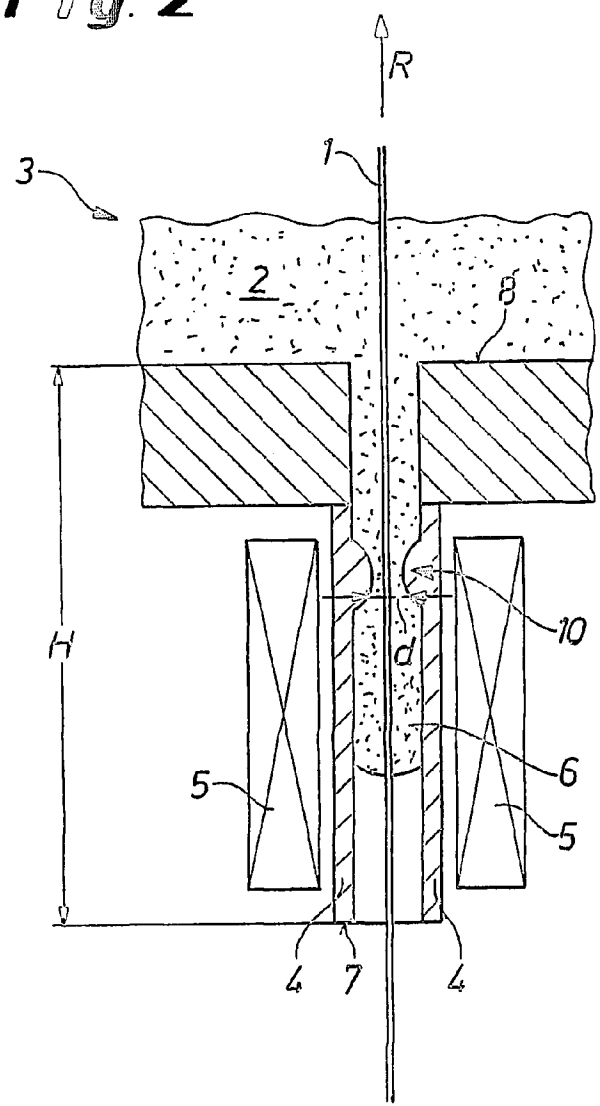
FIG. 2 shows an alternative embodiment to FIG. 1, showing only the region of the bottom of the coating tank and the guide channel extending downward from it.
Figure 4:
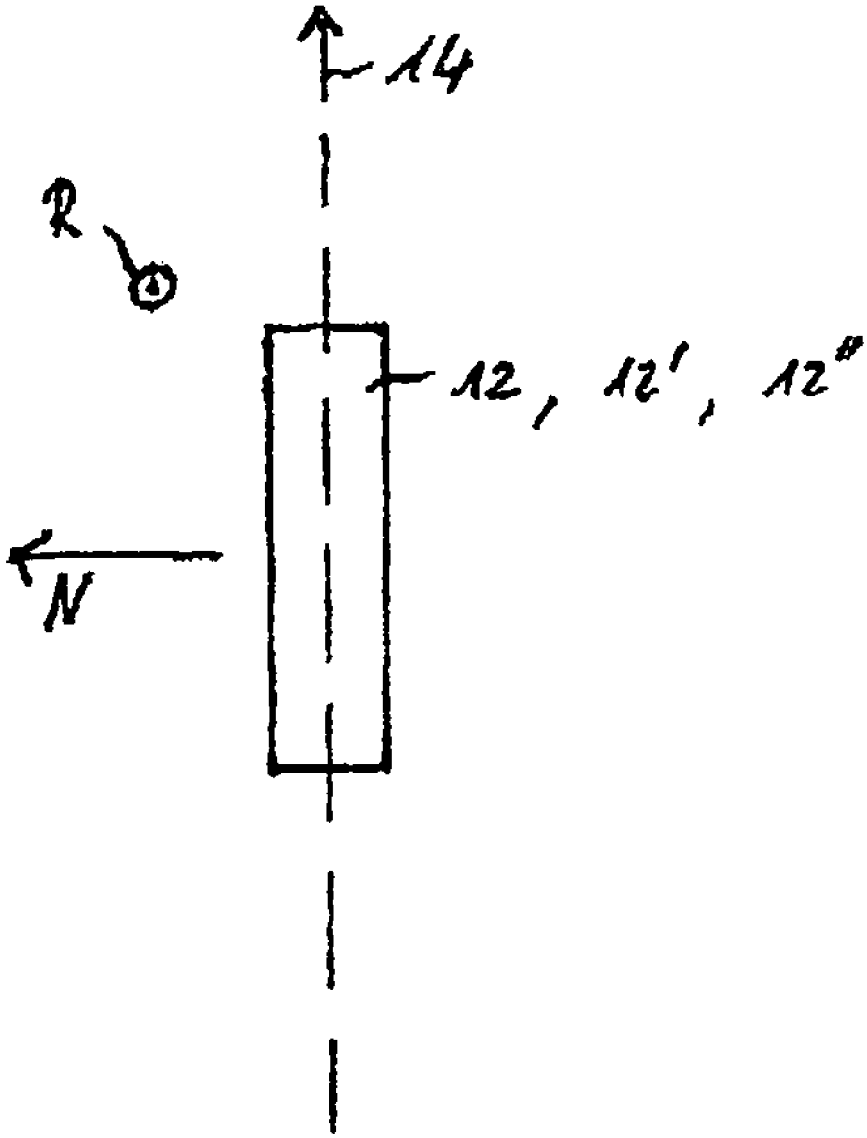
FIG. 4 shows an embodiment of the flow deflection element.

Other refinements, which are illustrated in FIGS. 2 and 3, are possible as measures for local limitation of the flow to the region of the guide channel 4.

In general, it can be said that the inductors 5 produce turbulent flow, especially in the guide channel 4, due to their pumping effect. As a measure for suppressing agitation on the surface of the bath, there is the possibility of making room for the escape of the turbulence already present in the region of the guide channel 4 by making changes in the geometry of the guide channel 4 or of impeding the spread of this turbulence into the coating tank 3 by weirs and thus limiting the turbulence to the region of the guide channel 4.

This is already accomplished to a considerable extent by the funnel-like section 9, which is illustrated in FIG. 1. In FIG. 2, it is alternatively or additionally provided that there is a constriction 10 in the region of the vertical extent H of the guide channel 4, which is a type of web or weir and is preferably located directly below the bottom 8 of the coating tank 3 (it has been found to be especially effective to place this constriction 10 in the region between the guide channel flange (not shown) and the bottom of the coating tank).

As FIG. 2 shows, the bounding walls 6 have the cross-sectional shape of a circular segment in the region of the constriction 10. This results in a certain amount of flow relaxation.

Above all, the constriction 10 hinders or prevents the turbulence from spreading into the coating tank 3. The aluminum depletion in the guide channel 4 that is to be feared with such a measure does not occur, since the volume of coating metal 2 in the guide channel 4 is very small, and the feeding of fresh coating metal from the coating tank through the guide channel is ensured by the normal removal of coating metal. Furthermore, the greater probability of strip contact (between metal strip 1 and constriction 2) that is to be feared with such a measure is very small, since ferromagnetic forces of attraction no longer prevail here, as in the channel region, and the self-centering of the metal strand 1 between the two sides of the constriction 10 by the effect of two baffle plates against which flow is occurring is well known. The design and shape of a weir of this type in the form of the constriction 10 and its clear width for the metal strand 1 conform to the fluid-mechanical requirements in the intermediate region between the guide channel 4 and the coating tank 3.

FIG. 3 illustrates another alternative embodiment, in which an expansion 11 is located in the region of the vertical extent H of the guide channel 4, specifically, above the vertical extent of the inductors 5 (which is also advantageous in the case of the embodiment shown in FIG. 2).

The expansion 11 in a certain way represents an equalizing volume between the guide channel 4 and the bottom 8 of the coating tank 3. In this way, the turbulence in the guide channel can already spread out and relax before it reaches the coating tank 3 and thus no longer affects the flow conditions in the coating tank 3. The flow in the guide channel 4 thus no longer continues into the coating tank 3 above it, but rather the coating metal 2 moves back into the lower region of the guide channel 4, in which the turbulence prevails.

The statements made above in connection with FIG. 2 with respect to possible aluminum depletion and to self-centering of the metal strand 1 also apply to this embodiment.

The drawings do not show a possible embodiment in which a constriction of the type shown in FIG. 2 can be located above the expansion 11.

As was explained above in connection with FIG. 2, the geometric design of the expansion 11 conforms to the fluid-mechanical requirements in the region between the guide channel 4 and the coating tank 3.

Another measure for locally limiting the flow to the region of the guide channel 4 is also illustrated in FIG. 3. Flow deflection elements 13 and 13' are arranged in the region of the expansion 11 and have the same function as the flow deflection elements 12, 12', 12", which were described above. Turbulence can be deflected downward again by the use of the flow deflection elements 13, 13' (in the form of guide webs or guide vanes) between the lower end 7 of the guide channel 4 and the bottom 8 of the coating tank 3. The flow deflection elements 13, 13' support the desired development of the flow conditions in the region of the expansion 11 and result in a reduction of turbulence.

The specified measures can be realized very easily, since metal as well as ceramic materials can be very readily worked and put together. They are also sufficiently resistant, which is an important consideration with respect to use in the aggressive environment of the coating metal 2.

It is especially preferred that the measures described in connection with FIGS. 1, 2, and 3 be used in combination, since such a combination results, all together, in low-turbulence flow in the guide channel 4 and in the coating tank 3 and thus in good relaxation of the surface of the coating metal 2 in the coating tank 3.

LIST OF REFERENCE SYMBOLS

1 metal strand (steel strip)
2 coating metal
3 coating tank
4 guide channel
5 inductor
6 bounding wall
7 lower end of the guide channel
8 bottom of the coating tank
9 funnel-like section
10 constriction
11 expansion
12, 12', 12" flow deflection element
13, 13' flow deflection element
14 longitudinal axis of the flow deflection element
15 surface of the coating metal

16 bath relaxation plate
17 actuator
d distance between the walls bounding the guide channel
N normal direction to the surface of the metal strand
H region of the vertical extent of the guide channel
h vertical extent of the funnel-like section
R direction of conveyance

The invention claimed is:

1. Device for hot dip coating a metal strand (1), said device comprising: a coating tank (3) that contains the molten coating metal (2) and a guide channel (4), wherein the guide channel (4) is arranged upstream, relative to the direction of travel of a metal strand (1), of the coating tank (3) such that the strand (1) is passed vertically through the guide channel (4) and then through the coating tank (3), and wherein the guide channel (4) is comprised of at least two inductors (5) for inducing an electromagnetic field, which are installed on both sides of the metal strand (1) in the area of the guide channel (4) in order to keep the coating metal (2) in the coating tank (3), wherein distance (d) between the walls (6) that bound the guide channel (4) is not constant in the direction (N) normal to the surface of the metal strand (1) in the region (H) of the vertical extent of the guide channel (4) between the lower end (7) of the guide channel (4) and the bottom (8) of the coating tank (3), such that the walls (6) that bound the guide channel (4) have a constriction (10) or an expansion (11), wherein at least one flow deflection element for reducing turbulence of the coating metal (2) therein is arranged in the guide channel (4).

2. Device in accordance with claim 1, wherein the cross section of the constriction (10) or the expansion (11) has essentially the form of a circular segment.

3. Device in accordance with claim 1, further comprising at least one additional wherein at least one flow deflection element is arranged in the coating tank (3) (4).

4. Device in accordance with claim 3, wherein the flow deflection element is designed as a flat, narrow plate, whose longitudinal axis (14) extends in the direction perpendicular to the direction of conveyance (R) of the metal strand (1) and perpendicular to the direction (N) normal to the surface of the metal strand (1).

5. Device in accordance with claim 3, wherein the at least one flow deflection element is arranged in the guide channel (4) in the region of the expansion (11).

6. Device in accordance with claim 3, wherein at least one bath relaxation plate (16) is arranged in the coating tank (3) near the surface (15) of the coating metal (2).

7. Device in accordance with claim 6, wherein the position of the bath relaxation plate (16) can be vertically adjusted by an actuator (17).

8. Device in accordance with claim 6, wherein the bath relaxation plate (16) consists of ceramic material.

9. Device in accordance with claim 8, wherein the flow deflection element is designed as a flat, narrow plate, whose longitudinal axis (14) extends in the direction perpendicular to the direction of conveyance (R) of the metal strand (1) and perpendicular to the direction (N) normal to the surface of the metal strand (1).

10. Device in accordance with claim 8, wherein the at least one flow deflection element is are arranged in the guide channel (4) in the region of the expansion (11).

11. Device in accordance with claim 1, wherein at least one bath relaxation plate (16) is arranged in the coating tank (3) near the surface (15) of the coating metal (2).

12. Device in accordance with claim 11, wherein the position of the bath relaxation plate (16) can be vertically adjusted by an actuator (17).

13. Device in accordance with claim 11, wherein the bath relaxation plate (16) consists of ceramic material.

* * * * *